United States Patent [19]

Bohl

[11] Patent Number: 4,458,436

[45] Date of Patent: Jul. 10, 1984

[54] SIGHT FOR SHOTGUNS

[76] Inventor: Thomas G. Bohl, Vasagatan 5, S-38200 Nybro, Sweden

[21] Appl. No.: 360,820

[22] Filed: Mar. 22, 1982

[30] Foreign Application Priority Data

Apr. 1, 1981 [SE] Sweden ..... 8102100

[51] Int. Cl.[3] ..... F41G 1/00; F41G 1/32

[52] U.S. Cl. ..... 42/1 S; 33/233; 33/241

[58] Field of Search ..... 42/1 S; 33/233, 241, 33/242, 243, 244

[56] References Cited

U.S. PATENT DOCUMENTS

| | | | |
|---|---|---|---|
| 2,486,940 | 11/1949 | Garber | 33/244 |
| 3,112,566 | 12/1963 | Jones | 33/233 |
| 3,166,848 | 1/1965 | Petzsch | 42/1 S |
| 3,500,545 | 3/1970 | Chivers | 33/241 |

FOREIGN PATENT DOCUMENTS 341911 1/1972 Sweden .

*Primary Examiner*—Charles T. Jordan

*Attorney, Agent, or Firm*—Finnegan, Henderson, Farabow, Garrett & Dunner

[57] ABSTRACT

Sight for shotguns with a forwardly widening conic frustum fixed to a mounting on the gun and having in its forward portion a ring extending inwardly from the frustum wall to define with its interior surface a sighting cone coaxial to the conic frustum. The ring emits red or orange light for example towards the shooter's eye, which contrasts with the background to the target. In a daylight version the translucent ring material is treated with a fluorescent agent and/or pigment, and in a night version light diodes are arranged in the ring.

11 Claims, 6 Drawing Figures

SIGHT FOR SHOTGUNS

The invention relates to a sight for shotguns, comprising a forwardly widening conic frustum of suitable material mounted on the gun, the axis of said conic frustum being substantially parallel to the gun barrel axis or the bisector of the axes of the gun barrels, said conic frustum defining a space, limited by the gun range, within which a target moving at commonly occurring speeds can be hit by the shot swarm from the barrel.

Such a sight is known by U.S. Pat. No. 3,112,566 for example, which describes a barrel-mounted conic frustum of thin sheet metal or plastic without any lens members or other optical devices. The forwardly increasing diameter of the conic frustum is adapted to the target speed in question, e.g. that of game birds, which is said to be 14.5–32 m/s and usually 13.4–20 m/s. The diameter of the cone should increase by approximately 1/12 of the length of the cone. The sight is used under the precondition that the shooter, regardless of the direction of movement of the target, will view the target at the intersection with the conic surface when firing. For any normal shooter, this precondition is quite odd, since it guarantees, as shown in a diagram in said specification, a miss within a sector where the target is moving nearly towards or away from the shooter. Of course, a normal shooter when shooting at a target coming directly towards him or away from him, aims the barrel directly at the target and will not aim the weapon with, in this case, an obviously false "lead".

Regardless of this, which probably would not affect the practical use of the known sight, the device has the disadvantage of too vaguely defining the space within which the target can be hit by the shot swarm from the barrel. The sighting cone is made with a thin wall, designed to obscure the target as little as possible when levelling, sweeping and shooting. When the eye of the shooter is correctly at the point of the sight cone, he sees the conic frustum as a single, thin ring.

Because of its vicinity to the eye and the minimal contrast by light reflection from the wall surfaces of the conic frustum, a displacement of the eye from the axis of the sight cone is discovered by the unadapted eye much too late and results in misaiming of the weapon. This is a serious disadvantage of the known sight, which is more pronounced in dim daylight and against the dark background of the forest, and is therefore unusable in practice.

The invention solves this problem by means of an inwardly extending ring disposed in the forwardmost portion of the conic frustum, the interior surface of said ring defining a sighting cone coaxial with said conic frustum.

According to one important feature of the invention, the ring is arranged to emit light towards the shooter's eye of such color, e.g. red or orange, as to contrast against the edge of the sighting conic frustum and against the color and light of the background to the target, e.g. the blue sky or the green forest.

Basically, a sight has been achieved which is easily discernible under shifting conditions and which can be quickly brought into correct orientation using secondary vision without any real sighting, since the shooter only need perceive an even red-orange ring.

By way of information, a few facts should be mentioned here about the nature of shot and the art of shooting with a shotgun, which in comparison with bullets and rifles is highly four-dimensional. The shot charge, which leaves the muzzle compactly at slightly over 400 m/s, is spread by the air into an elongated swarm with a continual rearrangement of the individual pellets, the velocity of which quickly drops. Many individual factors affect the spread of the swarm longitudinally and laterally. Roughly, however, after 0.1 second the swarm has reached about 35 m where it has a diameter of 0.75 m and a length of 7.5 m, and in which half of the pellet weight (core shot) is within a diameter of 0.5 m.

The spread makes it practically possible to hit a rapidly moving target with a number of pellets almost simultaneously, which for example kills small animals by shock. The hits take place not only within an area with an effective diameter of 0.5 m but continues for as long a period of time as 25/1000 of a second, during which time a fast bird can fly across the swarm and be hit by many pellets.

Due to the longitudinal and lateral extent of the swarm, the idea of lead is less distinct than in riflery. Most shotgun shooters quickly learn by instruction and experience which lead is required to hit a target. Many have difficulty with this however, and almost all such shooters lead too little, i.e. hit behind the target. Inhibition prevents them from directing the shot 2 meters in front of a flying duck, or more if it is flying in a tail wind.

The problem is thus primarily to remove the inhibition of these shooters against giving the target the proper lead. The inwardly extending luminescent red or orange ring according to the invention is arranged so that its inner edge clearly marks the extreme required lead which a shooter can expect under normal conditions in order to effectively hit a target moving only laterally, provided that the target moves towards the axis of the sight cone and that the ring is seen as an even, red ring. This lead is, as seen by the shooter, constant relative to the sight up to the longest range.

The red ring according to the invention provides a space defined by its inner edge within which the shooter has a feeling of contact with the target and is encouraged to lead the target as much as is required for these targets or targets at lower speeds and other flying angles relative to the shooter. As an aid to such a reduction of the lead, in one embodiment of the sight an inner ring has been marked corresponding to a half of the lead of the inner edge of the red ring. This inner ring provides, together with the outer luminescent red ring, because of the exceptional perception of the eye of the symmetry of the circles, an indication of the centre towards which the target is moving. Thus no special marking of the center in the sight is needed.

In an embodiment for daylight shooting, the ring is made of acrylic plastic for example, into which a fluorescent substance has been mixed, which even at dusk provides a strong, orange-red, non-glaring glow. It is then suitable that the rear edge surface of the ring be flat and mat and its inner and outer lateral surfaces be highly polished. The visible portion of the edge surface suitably has a radial width of 2–4 mm, suitably 2.5 mm, to provide optimal effect between perception and limitation of possible missighting. The luminosity of the ring is directly proportional to the width of the lateral surface and light received, for which it should have a free width for light intake of 15–20 mm.

The ring can be provided with four radially directed indices along two orthogonal diameters for indicating the vertical and horizontal planes of the shotgun, in order to more easily determine the location and direction of the target in relation to the center.

The inner ring can be a scribed line for example on an acrylic plastic disc mounted in the conic frustum behind the outer ring. It can also be a ring of dark wire mounted on an upright fixed to at least one cone wall.

In an embodiment for night shooting, e.g. shooting of fox with the aid of carrion bait, the ring is disposed to emit, in cooperation with at least one light source, e.g. a light diode, the rearwardly directed light.

A current source, e.g. at least one dry-cell battery, is mounted on the sight mounting for example and is connected via a switch and a control means for current strength to the light diode, so that the strength of the light directed by the ring backwards can be regulated. Suitably, 6–8 light diodes are distributed around the periphery of the ring. The diodes can be cast into the plastic material or be inserted in cavities around the ring. The portions of the ring not visible to the shooter's eye are in this case coated with a light-reflecting layer, e.g. a metal layer or a layer of white paint, while the rearwardly directed edge surface is untreated or mat. The ring can also be made with circular cross section as a torus with a highly polished exterior with a rearwardly directed, mat ring portion, the ring acting as a light conductor for a beam of light introduced tangentially, which is spread in the mat surface.

Night shooting seldom presents problems with leading, since nocturnal animals at carrion usually provide stationary targets.

The luminescent ring according to the invention serves in this use primarily to rapidly and precisely center the target within the core shot of the swarm with the target being illuminated by natural light and undisturbed by artificial light or illumination of the conventional sight means on the bridge of the gun. Centering of the target in the core shot with the luminous ring is much more precise than with conventional sights and the shooter is able to regulate the luminosity of the ring, so that it is sufficient and nonglaring.

The invention will be described in the following with two examples of embodiments with reference to the accompanying drawings.

Figure 1:
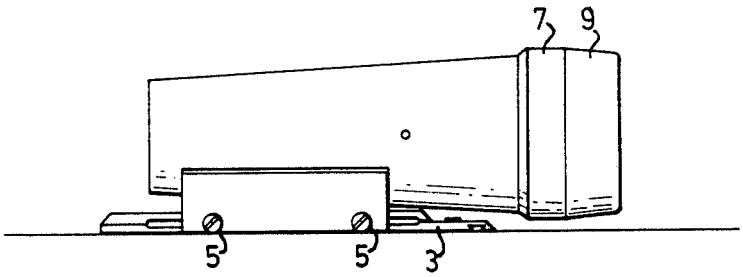
FIG. 1 shows a side view of a first embodiment for daylight shooting.

FIG. 1 shows a side view of a sight with a conical frustum of metal or plastic, which is slidably mounted on a bracket 3 and can be fixed by means of screws 5. The forward portion of the conic frustum has a thicker portion 7 as reinforcement and mounting for a ring 9. The ring 9 extends 2.5 mm inside the conical inner surface of the conic frustum 1 with a rearwardly directed edge surface 11 (see FIGS. 2 and 3) limited by an inwardly directed annular surface 13. The ring is held in place by any suitable means such as four screws (not shown) that extend into the thicker portion 7. The ring is made of acrylic plastic with fluorescent material mixed in. When the shooter holds his eye at the top of the sight cone, he will therefore see the edge surface 11, concentric with conic frustum 1, luminous with a red or orange light, which contrasts both with the edge surface of the sight cone and with any normal target background. Pairwise orthogonally arranged indices 17 are arranged on the edge surface 11 to mark the horizontal and vertical planes of the gun. The edge surface 11 is mat to spread the emitted light.

If the shooter holds his eye outside the axis of the sight cone, a portion of the edge surface 11 will be immediately hidden by the conic frustum 1, making quick correction of the sighting position possible. Displacement of the eye along the axis of the sighting cone is less important. The sighting cone has such a top angle that a target moving transversely towards the cone axis at 17.5 m/s will be hit by the central pellets of the shot at ranges from zero to maximum, if the target is visible at the ring surface 13. Because of the nature of the shot pattern, the target will be hit even at certain deviations from the lead indicated by the sight.

At the middle of the conic frustum there is a transparent disc 19 of acrylic plastic. The disc 19 has a scribed ring 21, the radius of which is seen by the shooter as half the radius of the ring surface 13.

Figure 2:
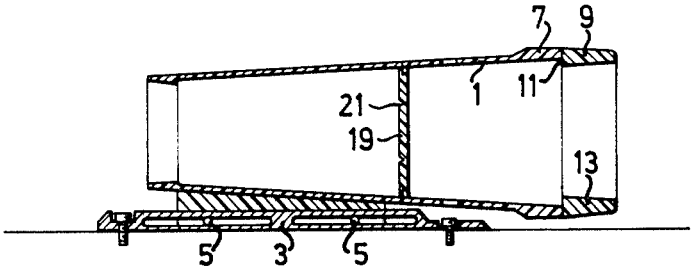
FIG. 2 shows a longitudinal section through the sight in FIG. 1.
Figure 3:
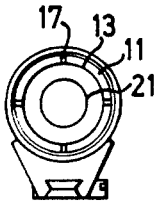
FIG. 3 shows the sight in FIG. 1 as seen from the rear when levelling.
Figure 4:
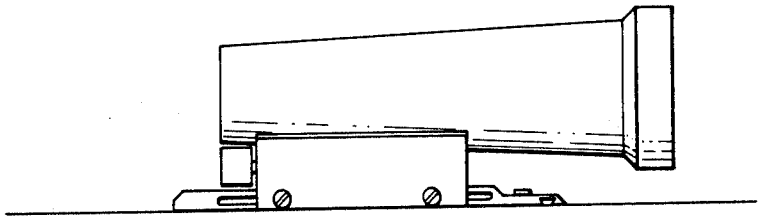
FIG. 4 shows another embodiment for night shooting.
Figure 5:
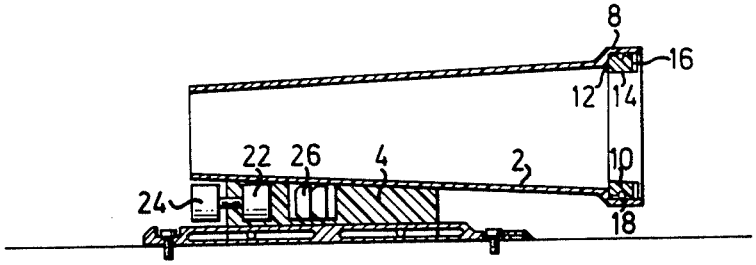
FIG. 5 shows a longitudinal section through the sight in FIG. 4 with its mounting, light-regulator means and battery holder.
Figure 6:
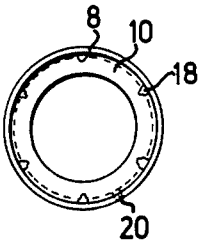
FIG. 6 is a rear view of the ring in FIG. 5.

FIGS. 4 and 5 show in a corresponding manner to FIGS. 1 and 2 the sight arranged for night shooting. The two sights only differ essentially in regard to the design of the ring and the arrangements in the mounting, and therefore the other components need not be described in more detail here. The ring 10 is mounted in a thick portion 8 at the front of the conic frustum and is made of translucent acrylic plastic. Its annular surface 14 as well as the forward edge surface 16 are covered with foil or white paint, while its rear edge surface 12 is mat. As shown particularly in FIG. 6, the periphery of the ring has six evenly distributed light diodes 18, and wires cast or mounted in the ring 10. The wires lead to connecting means 20 arranged for connection to wires (not shown) along the conic frustum 2 to an adjustable rheostat 22 with a knob 24 at the rear of the sight and to battery cells 26 in the mounting 4.

The six light diodes 18 evenly distributed around the ring 10 emit a red light which is perceived by the shooter's eye as an even, red ring of 2.5 mm width in the sight and which permits simple correct centering of the core shot to the target.

What I claim is:

1. A sight for a shotgun having a barrel and a swarm shot pattern comprising a forwardly widening conic frustum adapted to be mounted on the gun, the axis of said conic frustum being substantially parallel to the axis of the barrel of the gun, the conic frustum defining a space for the user's eye within which a moving target at commonly occurring speeds up to the range of the gun can be hit by the shot swarm from the barrel, and a translucent ring in the forward portion of the conic frustum, the ring extending inwardly from the wall of the conic frustum to define with its inner ring surface a sighting cone coaxial with the conic frustum to assist the user in keeping his eye on the axis of sight.

2. The sight of claim 1, in which the rearwardly facing surface of the ring is luminous and emits towards the eye of the user light of a color that contrasts with the color of the background of the target.

3. The sight of claim 2, wherein the ring is of an acrylic plastic, treated with a fluorescent agent, so that daylight entering the forward portion of the ring lights the rear face of the ring.

4. The sight of claim 3, in which the fluorescent agent is mixed into the plastic.

5. The sight of claim 2, including at least one light source in the ring adapted to light the rearwardly directed face of the translucent ring and a current source connected to the light source via a current regulator means.

6. The sight of any one of claims 1–4 in which the tip angle of the conic frustum is selected so that a target with the highest occurring speed transverse to its axis will be hit by the shot swarm when the target is visible at the inner ring surface of the translucent ring.

7. The sight of claim 1 in which the rearwardly facing surface of the ring has a width of 2–4 mm.

8. The sight of claim 1 wherein the rearwardly facing surface has a mat finish.

9. The sight of claim 1 wherein the ring is interchangeable in the conic frustum.

10. The sight of claim 1 including an inner ring concentrically mounted in the conic frustum between the eye of the user and the translucent ring, the inner ring having a radius of approximately one-half the radius of the inner ring surface of the translucent ring.

11. The sight of claim 10 wherein the inner ring is a circular line scribed on a transparent disc fixed in the conic frustum.

* * * * *